US007886649B2

(12) United States Patent
Pettersson et al.

(10) Patent No.: US 7,886,649 B2
(45) Date of Patent: Feb. 15, 2011

(54) WEAPON SYSTEM

(75) Inventors: Rolf Pettersson, Torshälla (SE); Eje Lantz, Eskilstuna (SE); Lars Ax, Tullinge (SE); Kent Norgren, Karlskoga (SE)

(73) Assignee: SAAB AB, Linköping (SE)

( * ) Notice: Subject to any disclaimer, the term of this patent is extended or adjusted under 35 U.S.C. 154(b) by 231 days.

(21) Appl. No.: 12/336,789

(22) Filed: Dec. 17, 2008

(65) Prior Publication Data

US 2011/0005375 A1 Jan. 13, 2011

(30) Foreign Application Priority Data

Dec. 17, 2007 (EP) ..... 07123367

(51) Int. Cl.
*F41A 1/08* (2006.01)

(52) U.S. Cl. ..... 89/1.701; 89/1.702

(58) Field of Classification Search ..... 89/1.7, 89/1.701, 1.702
See application file for complete search history.

(56) References Cited

U.S. PATENT DOCUMENTS

| | | | | |
|---|---|---|---|---|
| 4,426,910 | A | 1/1984 | Speer | |
| 5,109,750 | A | 5/1992 | Kayaian | |
| 6,446,535 | B1 * | 9/2002 | Sanford et al. | 89/1.701 |
| 6,626,286 | B2 | 9/2003 | Boutet et al. | |
| 6,971,299 | B2 * | 12/2005 | Franzen et al. | 89/1.701 |
| 7,418,896 | B1 * | 9/2008 | Dindl et al. | 89/1.701 |
| 2010/0031809 | A1 * | 2/2010 | Lantz et al. | 89/1.702 |

FOREIGN PATENT DOCUMENTS

| | | | |
|---|---|---|---|
| EP | 1484572 | A1 | 12/2004 |
| EP | 1593926 | A1 | 11/2005 |
| EP | 1808663 | A1 | 7/2007 |
| EP | 1914507 | A1 | 4/2008 |
| FR | 95452 | E | 12/1970 |
| GB | 1288732 | A | 9/1972 |
| WO | WO01/53772 | A1 | 7/2001 |

OTHER PUBLICATIONS

European Search Report—May 30, 2008.

* cited by examiner

*Primary Examiner*—J. Woodrow Eldred
(74) *Attorney, Agent, or Firm*—Venable LLP; Eric J. Franlkin

(57) ABSTRACT

A modular weapon system of a preloaded recoilless gun including a barrel provided with a shell, a propellant charge and a countermass. The weapon system is configured in two parts including a first part of the barrel and a second part of the barrel. The first part of the barrel includes the shell and the second part of the barrel includes the propellant charge and countermass. A releasable locking device interconnects the second part of the barrel with the first part of the barrel.

10 Claims, 2 Drawing Sheets

WEAPON SYSTEM

CROSS-REFERENCE TO RELATED APPLICATIONS

This application claims priority to European patent application 07123367.0 filed 17 Dec. 2007.

BACKGROUND OF THE INVENTION

1. Technical Field of the Invention

The present invention relates to a preloaded recoilless gun of a disposable type as an AT4CS support weapon, which is normally ready for missions requiring an immediate action of effective fire, be it in a confined space inside a building or other space in the battle field. More particularly, the invention relates to a weapon system which is mainly adapted for use in providing enhanced, so called, IM (Insensitive Munitions) characteristics during handling, transport and storing of support weapons of the indicated type, by means of a modular weapon system of a preloaded recoilless gun comprising a barrel provided with a shell, a propellant charge and a countermass.

2. Description of Related Art

When handling, transporting and storing weapons of the initially mentioned kind, e.g. individually, during troop movements, transporting and storing in boxes or otherwise, there is in some cases a potential chance of an accidental firing of the propellant charge and a closely following detonation, if the shell should exit the barrel of the weapon, which would lead to possible fatal consequences. In this connection, reference might be made to our EP-application 06100439.6, which shows an example of a method of configuring a weapon comprising a countermass of the indicated kind in transport mode, for restraining a shell in the barrel of said weapon. However, up till now the related technical field of modular weapons systems lacks a suitable solution regarding providing enhanced IM characteristics and which simultaneously enable different alternatives of effective fire in one barrel, the recoilless characteristics essentially maintained.

SUMMARY OF THE INVENTION

It is an object of the present invention to provide a modular weapon system of the initially mentioned kind which is capable of preventing a shell from exiting the barrel of the weapon should the propellant charge of the shell be accidentally ignited, and thereby preventing an accidental explosion of the shell in the vicinity.

A further object is to provide a modular weapon system which enables use of shells of different weights and by means of adapting one or more of the cartridge case, propellant/powder charge, countermass and/or the expansion section always achieve a recoilless weapon with optimal characteristics.

For this purpose the modular weapon system according to the present invention is configured with at least two parts comprising a fore part of the barrel and a rear part of the barrel, said rear part comprising said countermass and by means of a releasable locking device interconnected with said fore part in an assembled state of the gun.

Further features of the weapon system of the invention will be apparent from the following detailed description with reference to the accompanying schematic drawing.

ADVANTAGES

By means of the modular weapon system according to the invention it is possible to match different parts of the system to almost every specific activity. By use of one and the same barrel it is still achievable to vary the weight of the shell and by matching one or more of the powder quantity of the propellant charge in the cartridge case, the countermass and/or the expansion section and/or the outlet section of the gun always achieve optimal, practically recoilless characteristics of the gun. Hence, dependent on the present state of alert it is achievable to on one hand operate a readily assembled variant of the gun or a variant which meets very high IM-standards which requires an in-situ assembly before it is ready to operate on the other.

Further advantages involve a minimal danger-zone behind the gun thanks to the combined expansion section and countermass tube. Thanks to the divisible barrel a relatively short pack-length is achievable. Modularity is enabled by means divisibility into theoretically five separate parts: The first part of the barrel, the shell (A, B, C etc.), the cartridge case (a, b, c etc.), the countermass tube and the outlet section appropriately configured. Still, in an assembled state reliable CS-characteristics can be achieved.

Dependent on desired performance the outlet tube might be configured with a neutral, a converging or a diverging section and of varying length, in order to control muzzle velocity, acoustic pressure, recoil and system length.

Advantageously, thanks to the modularity/separability the design enables a simple destruction after the useful lifetime has expired. The system is relatively flexible, in that each part can be developed further individually.

Finally, an effective combustion of powder is achievable, thanks to the possibility to configure the propellant chamber/cartridge case with regard to the present powder quantity and/or the present shell, countermass etc.

DESCRIPTION OF EMBODIMENTS OF THE INVENTION

Figure 1:
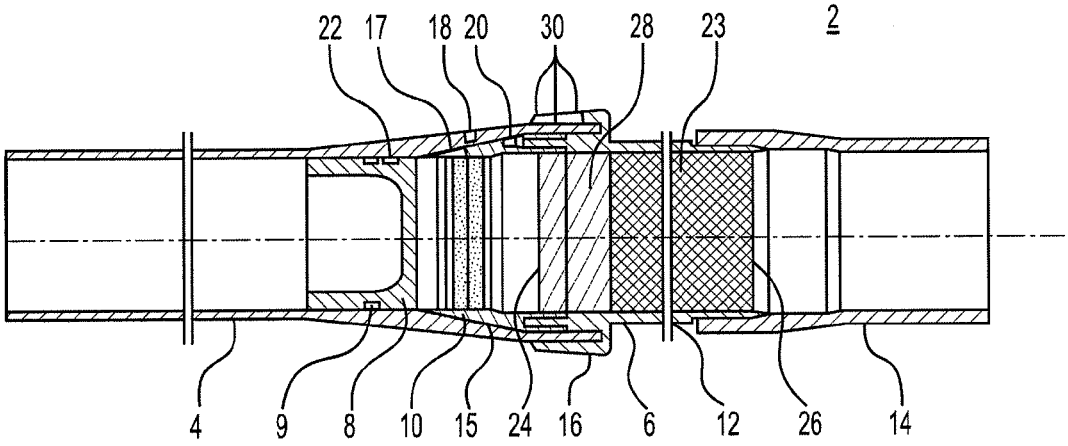
FIG. 1 is a longitudinal view in section of a preloaded recoilless gun assembly according to the modular weapon system of the invention.
Figure 2:
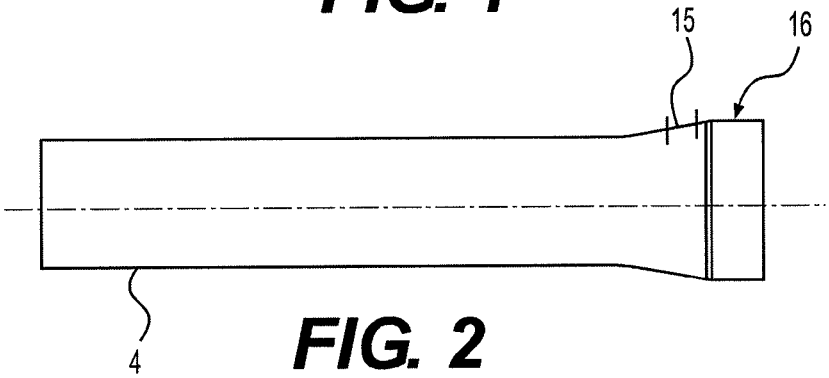
FIG. 2 is a fractional side view of the gun showing a fore part of its barrel.
Figure 3:
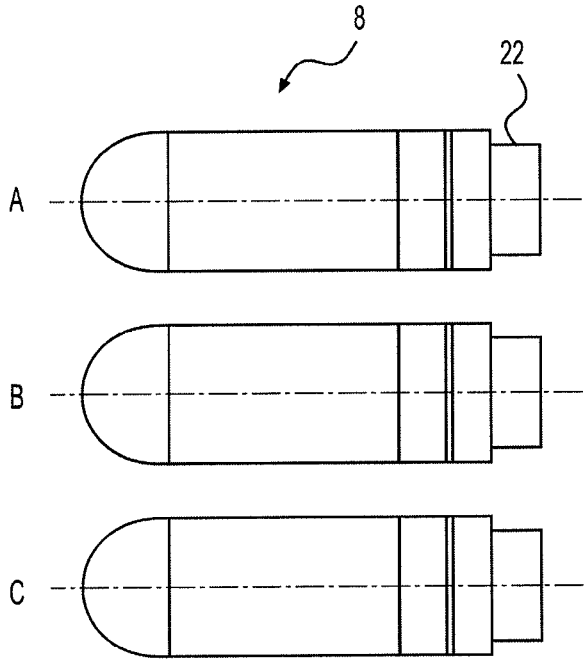
FIG. 3 is a fractional side view of the gun shoving different shells loadable in the fore part of the barrel.
Figure 4:
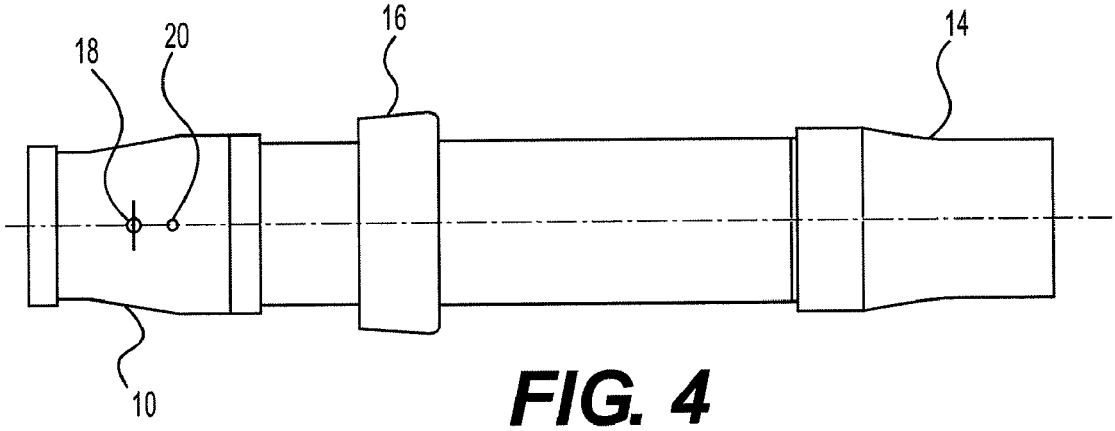
FIG. 4 is a fractional side view of the gun shoving a rear part of the barrel.
Figure 5:
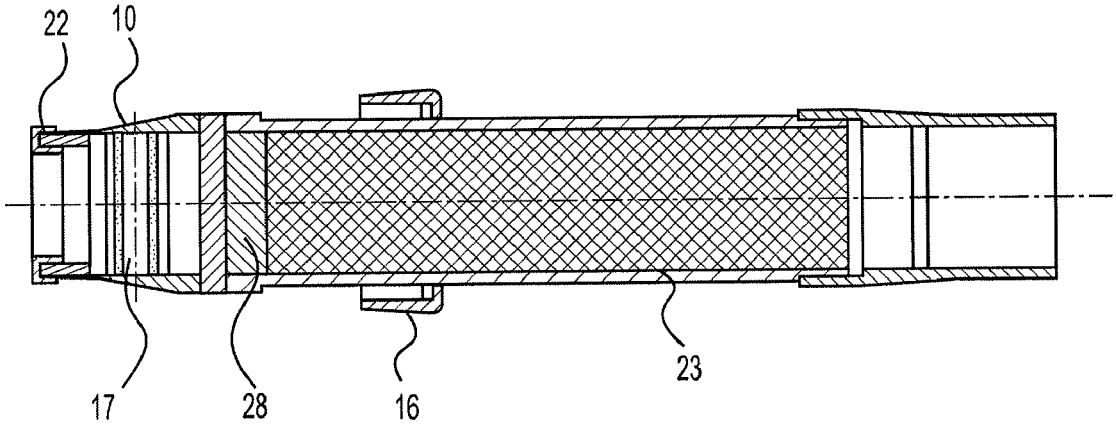
FIG. 5 is a longitudinal section of FIG. 4.

FIG. 1 is a side view of a preloaded recoilless gun assembly 2 according to the modular weapon system of the invention. Unlike a conventional weapon of this kind said gun assembly 2 can in a simple way be divided in the middle, in that the conventional weapon regarded in the firing direction be divided in two main parts, a fore or first part 4 and a rear or second part 6 of the barrel. The interconnection of said first and second parts of the barrel will be described in more detail later.

Accordingly, said modular system comprises said first part 4 of the barrel provided with a shell 8 and said second part 6 of the barrel including a generally conical cartridge case 10 which, in its greater diameter end by means of a conventional joint, e.g. glue line, threading, bayonet fitting etc., can be associated with a countermass tube 12, which in turn at its rearmost end by similar means of joint might be provided with an outlet section 14. Said countermass tube 12 is operating as an expansion section of the second part 6 of the barrel as well. Advantageously, said shell 8 can be provided with a girdle 9, of e.g. a resilient material, which by means of a relatively small friction can assist in keeping the shell 8 within the first part 4 of the barrel. For different targets the shell 8 might be of a predetermined magnitude and/or configured with an alternative specific weight (A, B, C etc.).

Suitably, the first part 4 of the barrel is configured with a complementary shaped conical seating 15 for receiving said conical cartridge case 10 in a tight fit and achieving a firm and secure attachment of the joint between the first- and second parts 4, 6 of the barrel. The contact surfaces be of a sufficient finish to minimize any leakage and improve the firm fit of the joint. In order to secure that the conical cartridge case 10 be thoroughly seated in said conical seating 15, a locking device preferably configured as axial locking ring 16, in a conventional manner is rotatably attached to foremost part of the countermass tube 12 (the second part 6 of the barrel). Said locking ring 16 e.g. is provided with a conventional inner thread, bayonet joint etc. and the outer greater diameter of the conical seating 15 is provided with a complementary external thread, bayonet joint etc. Advantageously, for example by tightening the locking ring 16 onto the external thread of the conical seating 15 with a predetermined torque, the conical cartridge case 10 will be secure and thoroughly seated in the conical seating 15.

Preferably, said cartridge case 10 can in a conventional manner be provided with a propellant charge 17 and a percussion cap 18. The cartridge case is configured with a sufficient space to enable propellant charges of different powder quantity (a, b, c etc.), depending on the required thrust needed to launch a specific one of the shell 8, e.g. being of a specific weight (A, B, C etc.). The first part 4 of the barrel is in turn provided with a firing mechanism of a common kind comprising, on the conical seating 15, a firing pin (not shown), configured to hit said percussion cap 18 on a launching situation. This is enabled in that the conical cartridge case be provided with a roller guide 20 for the percussion cap, e.g. a peg and groove, for a proper guidance of the rotational positioning of the cartridge case 10 in the conical seating 15 when the gun assembly 2 is put together.

Suitably, the conical cartridge case 10 in its smaller diameter end can be provided with an inner thread, groves, a mechanical joint or similar connection means provided with brake indications which in combination with complementary connection means of the shell 8 can be brought into a constitution of a fitting 22 configured to give away on firing off the shell. Our pending European patent application No. 06122573.6 discloses a releasable coupling of this kind.

Advantageously, the countermass tube 12 in accordance with the prior art, which is not described in particular here, can be filled with a countermass 23 of any conventional kind e.g. in solid form (powder), liquefied (liquid, tixotropic), liquid absorbed in a liquid binder of Oasis type etc. The quantity of countermass 23 in the countermass tube 12 is adaptable to the weight of the chosen shell 8, which sets the required thrust and the quantity of propellant charge 17 required for launching the shell appropriately. Suitably, the quantity of countermass 23 can be varied by varying the length and/or diameter of the countermass tube 12 or by using countermass of different densities. In the end facing the cartridge case 10 the countermass tube 12 can be provided with an openable cover 24 with break indications and an openable bottom 26 with break indications in the other, rearmost end.

A suitable openable closing member as an alternative to said openable cover 24 and openable bottom 26 respectively is disclosed in our patent E-B1-1593926. Further, the countermass tube 12 can be provided with a pressure compensating means 28 of a conventional kind, located between the countermass 23 and the openable cover 24, and in the rearmost end with the openable bottom 26 the countermass tube 12 can be provided with the outlet section 14. Dependent on desired performance the outlet tube might be configured with a neutral, converging or diverging section and in varying lengths in order to control muzzle velocity, acoustic pressure, recoil, system length etc.

Where appropriate, one or more conventional sealing rings 30 might be used to further improve the ablation areas, on one hand between the conical seating 15 and the conical cartridge case 10 and between the latter and the counter mass tube 12 on the other.

Suitably, the gun can be produced of metals like steel or of synthetic materials, e.g. composite materials including fiber reinforced plastics, or of any appropriate material or combination of materials.

OPERATION

During handling and transport, storage, shipping etc. it is preferred to meet high standards of IM-solutions. Principally, this is possible in that the gun assembly 2 can in a simple way be divided in the middle by releasing the axial locking ring 16, regarded in the firing direction in the first part 4 of the barrel, where appropriate containing the shell 8, and the second part 6 of the barrel comprising the cartridge case 10 with the propellant charge 17 and the countermass 26.

Consequently, it is achievable to separate the first part 4 of the barrel including the shell 8 from the second part 6 of the barrel including the propellant charge 17 and the countermass 26. This is a major advantage regarding high levels of IM-solutions, as it is possible to store the first part 4 of the barrel including the shell 8 separated from the second part 6 of the barrel including the propellant charge 17 and the countermass 26.

Alternatively, the shell 8 can be separated from the first part 4 of the barrel and located separately outside the barrel, which is advantageous as, depending on the present target characteristics, it is desirable to provide alternative projectiles or shells 8 in one and the same barrel.

Further, it can be achievable to separate even the cartridge case 10 from the countermass tube 12 and where appropriate separate even the outlet section 14 from the countermass tube 12. Suitably, it might be achievable to provide a plurality of the cartridge case 10 configured with propellant charges (a, b, c etc.) of different powder quantity. Depending on the required thrust needed to launch a specific one, e.g. the shell 8 being of a specific weight (A, B, C etc.), a corresponding matching one (a, b c etc.) of the cartridge case 10 is chosen. Then, the cartridge case 10 might be stored separately from the shell or more preferred assembled with the countermass tube 12 and an appropriate outlet section 14 into the second part 6 of the barrel, which then is stored separately from the shells.

Consequently, where appropriate, it would even be achievable to store each of the shell 8, cartridge case 10, countermass tube 12 and outlet section 14 separately or in a separate compartment of a not shown transport box.

The invention claimed is:

1. A modular weapon system of a preloaded recoilless gun, comprising:

a barrel provided with a shell, a propellant charge and a countermass, wherein said weapon system is configured in at least two parts comprising a first part of the barrel and a second part of the barrel, said first part of the barrel comprising said shell and said second part of the barrel comprising said propellant charge and countermass a releasable locking device configured to be interconnected with said first part of the barrel in an assembled state of the weapon system.

2. The modular weapon system according to claim 1, wherein in a disassembled IM-state of the weapon system the first part of the barrel is stored separated from the second part of the barrel.

3. The modular weapon system according to claim 2, wherein the first part of the barrel is stored separated from the shell.

4. The modular weapon system according to claim 3, wherein at least one shell is stored separately in compartment of a transport box.

5. The modular weapon system according to claim 1, wherein each shell has a predetermined magnitude.

6. The modular weapon system according to claim 2, wherein the second part of the barrel is stored separately from a cartridge case comprising the propellant charge.

7. The modular weapon system according to claim 6, wherein at least one cartridge case is stored separately in compartment of a transport box.

8. The modular weapon system according to claim 1, wherein each cartridge case comprises a predetermined powder quantity.

9. The modular weapon system according to claim 2, wherein the countermass is provided in a countermass tube stored separately in compartment of a transport box.

10. The modular weapon system according to claim 1, further comprising:

an outlet section connectable with a rearmost part of the second part of the barrel and stored separately in compartment of a transport box.

* * * * *